US007472972B2

(12) United States Patent
Ehrlich

(10) Patent No.: US 7,472,972 B2
(45) Date of Patent: Jan. 6, 2009

(54) FILING CABINET HAVING A FIREPROOF RETRACTABLE DOOR

(75) Inventor: Donald J. Ehrlich, Lafayette, IN (US)

(73) Assignee: Schwab Corporation, Lafayette, IN (US)

( * ) Notice: Subject to any disclaimer, the term of this patent is extended or adjusted under 35 U.S.C. 154(b) by 300 days.

(21) Appl. No.: 11/209,522

(22) Filed: Aug. 23, 2005

(65) Prior Publication Data

US 2006/0038469 A1 Feb. 23, 2006

Related U.S. Application Data

(60) Provisional application No. 60/603,731, filed on Aug. 23, 2004.

(51) Int. Cl.
*A47B 88/00* (2006.01)

(52) U.S. Cl. ..... 312/323; 312/328

(58) Field of Classification Search ..... 312/323, 312/322, 326, 327, 328; 16/286, 239; 49/257, 49/386, 387; 109/70

See application file for complete search history.

(56) References Cited

U.S. PATENT DOCUMENTS 1,386,738 A * 8/1921 Sonnenberg ..... 49/257
1,414,843 A 5/1922 Voss
1,513,849 A 11/1924 Moore
1,873,247 A 8/1932 Abbott et al.
1,873,522 A 8/1932 Abbott et al.
1,876,192 A 9/1932 Wolters
1,922,487 A * 8/1933 Meilink ..... 49/257
1,964,578 A 6/1934 Hunter
1,990,300 A 2/1935 Miller
2,116,370 A 5/1938 Watkins
2,347,705 A 5/1944 Mosler et al.
2,598,255 A 5/1952 Henkel
3,677,259 A * 7/1972 Doner ..... 126/194
3,817,589 A 6/1974 Anderson
3,888,557 A 6/1975 Anderson et al.
4,303,286 A 12/1981 McClellan
6,499,189 B2 * 12/2002 Kondo et al. ..... 16/289
2004/0177476 A1 * 9/2004 Zetti ..... 16/287

* cited by examiner

*Primary Examiner*—José V Chen
*Assistant Examiner*—Matthew W Ing
(74) *Attorney, Agent, or Firm*—Trexler, Bushnell, Giangiorgi, Blackstone & Marr, Ltd.

(57) ABSTRACT

A fireproof filing cabinet is disclosed. The cabinet has a shelf on which material such as files can be stored, having an open front side enclosable by a fireproof door. The door rotatably engages a retracting mechanism having a lift assist, so that the door rotates from a closed position, enclosing and sealing the shelf, to an open position, and then to a retracted position inside a compartment mounted adjacent to the shelf A lift assist mechanism enables opening and closing the door.

8 Claims, 5 Drawing Sheets

FILING CABINET HAVING A FIREPROOF RETRACTABLE DOOR

CROSS-REFERENCE TO RELATED APPLICATION

This application claims the benefit of U.S. provisional patent application Ser. No. 60/603,731, filed on Aug. 23, 2004, which is incorporated herein by reference.

BACKGROUND OF THE INVENTION

This invention relates to the field of fireproof filing cabinets.

Conventional file cabinets, used commonly in homes and offices, have a door or drawer front that retracts and slides into a compartment, to expose an open shelf that can be used for binder storage or side tab files. Conventional fireproof cabinets have a joint at the front wall that interlocks with the door to keep the interior from exceeding 350° F. when exposed to a temperature of 1,700° F. for one hour. There has not previously been a door or drawer front that can be retracted into a compartment because of the requirement of ajoint at the front. There is a need for a conventional filing cabinet that is also fireproof. The present invention meets that need.

The present invention provides a fireproof filing cabinet which overcomes the problems presented in the prior art and which provides additional advantages over the prior art. These advantages will become clear upon a reading of the attached specification in combination with a study of the drawings.

BRIEF SUMMARY OF THE INVENTION

Briefly, and in accordance with the foregoing, a fireproof filing cabinet is provided. The fireproof filing cabinet has a shelf on which material such as files can be stored, having an open front side enclosable by a fireproof door. The door rotatably engages a retracting mechanism having a lift assist, so that the door rotates from a closed position, enclosing the shelf, to an open position, and then to a retracted position inside a compartment mounted adjacent to the shelf. A lift assist mechanism enables opening and closing the door.

BRIEF DESCRIPTION OF THE DRAWINGS

The organization and manner of the structure and operation of the invention, together with further objects and advantages thereof, may best be understood by reference to the following description, taken in connection with the accompanying drawings, wherein like reference numerals identify like elements in which.

DETAILED DESCRIPTION OF THE INVENTION

Figure 1B:
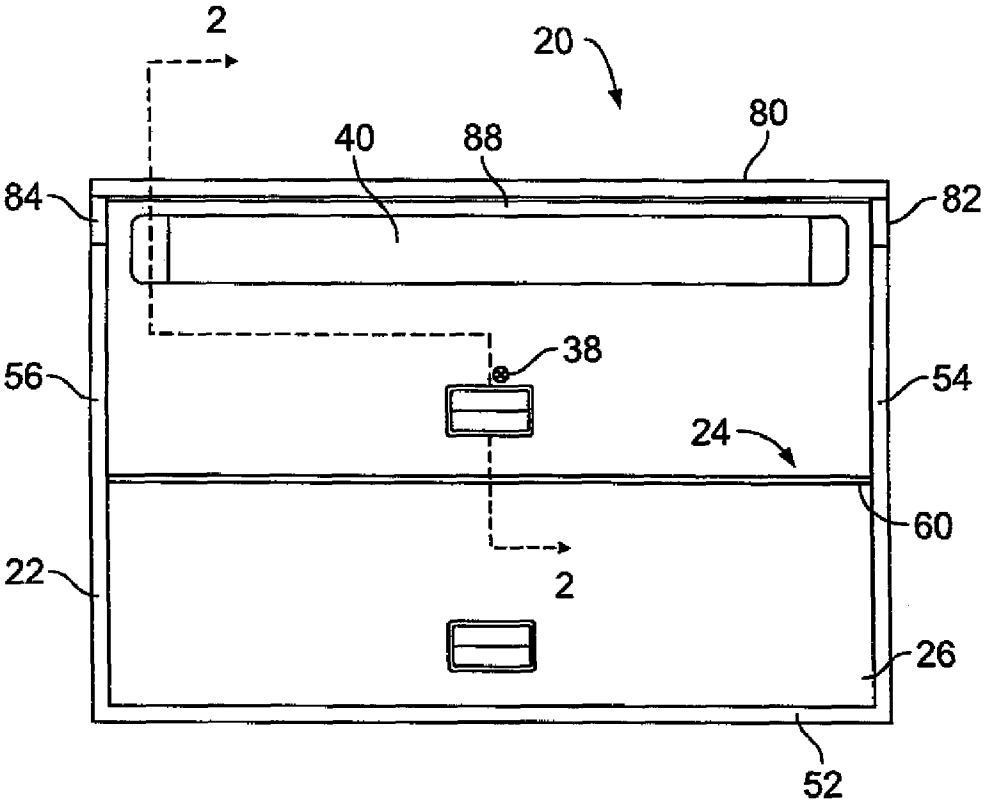
FIG. 1B is a front elevational view of the cabinet.

While the invention may be susceptible to embodiment in different forms, there is shown in the drawings, and herein will be described in detail, a specific embodiment with the understanding that the present disclosure is to be considered an exemplification of the principles of the invention, and is not intended to limit the invention to that as illustrated and described herein.

Figure 1A:
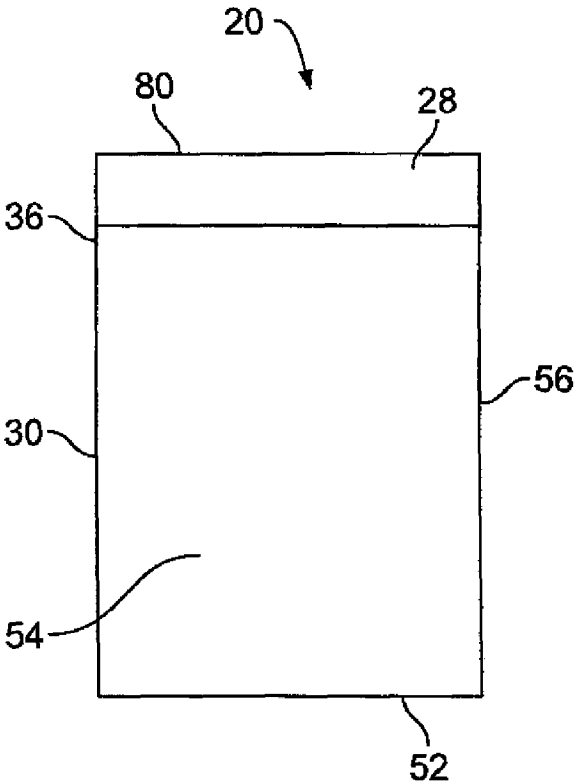
FIG. 1A is a side elevational view of a cabinet of which incorporates the features of the present invention.
Figure 2:
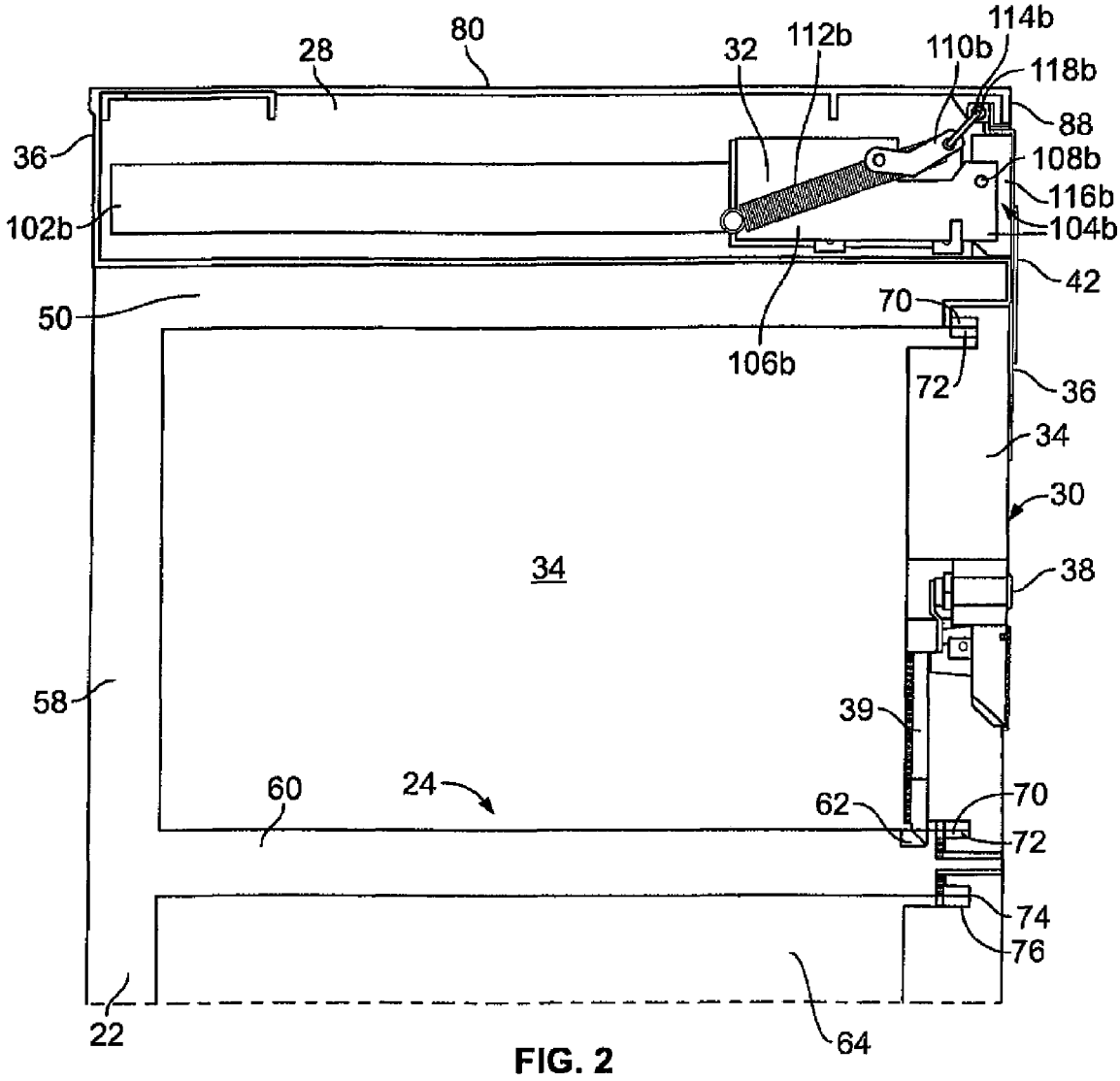
FIG. 2 is a cross-sectional view of the cabinet along line 2-2 of FIG. 1B.

A fireproof filing cabinet 20 of the preferred embodiment of the present invention is shown in a side elevational view in FIG. 1A, in a front elevational view in FIG. 1B, and in a side cutaway view in FIG. 2. The filing cabinet 20, in the illustrated embodiment, is a two-tier filing cabinet, with a retractable door on an upper shelf and a fixed door on a lower drawer. Other combinations are, of course, possible.

The fireproof filing cabinet 20 includes a frame 22 having an upper shelf 24 and a lower drawer 26 which is mounted on drawer supports (not shown). The fireproof filing cabinet 20 further includes a compartment 28 mounted on top of the frame 22. A door 30 is retractably mounted to the compartment 28 to extend over the open front of the upper shelf 24 and to retract into the compartment 28 by use of a retracting mechanism 32 attached to door 30. Please note that the compartment 28 of the preferred embodiment forms an enclosed cavity 34 but compartment 28 need not be totally or partially enclosed and can have only partial walls or only frame members defining it.

The door 30 has a main body 34 and a door extender 36 extending from the main body 34. The door 30 is preferably made to meet the Underwriters Laboratory Class 350 rating. Accordingly, the main body 34 includes a front portion and a rear portion. Insulation, for example, insulation sold under the trademark, INSULITE@, by E. H. O'Neill Company, Inc., is provided between the front portion and the rear portion of the main body 34, in order to meet the heat conduction requirements of the UL Class 350 rating. In the preferred embodiment, the main body 34 is one foot high and four feet wide, so that the width of the main body 34 is slightly less than the width of the compartment 28 and the width of the frame 22 and slightly greater than the interior width of the shelf 24. The main body 34 preferably includes a conventional locking mechanism 38 having a latch 39, mounted on the rear portion of the main body 34. The door extender 36 extends upwardly from an upper portion of the outer surface of the main body 34. The door extender 36 is a flat plate which extends across, and covers, an aperture 40 in compartment 28 when the door 30 is a closed position. The door extender 36 is secured to the main body 34 by welds, screws, nuts and bolts, or other suitable means. The door extender 36 extends generally along the entire length of the main body 34. A reinforcing plate 42 overlaps a mid-portion of the door extender 36 and is secured to the door extender 36 by welds, screws, nuts and bolts, or other suitable means. The reinforcing plate 42 reinforces the section of the door extender 36 beyond the main body 34. The door extender 36 and the reinforcing plate 42 are preferably formed of steel, most preferably of the same type and painted the same color as the main body 34.

The frame 22 is generally rectangular and includes a generally horizontal top wall 50, a generally horizontal bottom wall 52, a generally vertical left wall 54, a generally vertical right wall 56, a generally vertical rear wall 58, and a horizontal partition wall 60 which separates the shelf 24 from the drawer 26. The frame 22 is formed from metal, preferably steel.

In the illustrated embodiment, top wall 50, partition wall 60, the upper portion of the wall 54, the upper portion of right wall 56, and the upper portion of rear wall 58 define a shelf cavity 34. Thus, the shelf cavity 34 is closed on five sides and has an open front, so that material, such as files, can be placed on the shelf 24. The shelf 24 can be a platform mounted on the partition wall 60, or the partition wall 60 can be the shelf 24. When the door 30 is retracted or is opened, as will hereinafter be described, a user can access material on the shelf 24 from outside the cabinet 20, as the shelf 24 is open on the front of the cabinet 20. Bottom wall 52, partition wall 60, the lower portion of left wall 54, the lower portion of right wall 56, and the lower portion of rear wall 58 define another cavity 64 in which the drawer 26 is provided.

The shelf 24 can be mounted on rollers that engage sliders attached to the side walls 54, 56, so that the shelf 24, when the door 30 is open or retracted, as hereinafter described, can slide out of the frame 22. Moreover, while cabinet 20 is shown with only a single drawer 26, additional drawers can be provided underneath the drawer 26. Also, the frame 22 can be designed without drawer 26 such that only shelf 24 is provided, or a plurality of shelves 24 can be provided, each with an associated compartment 28.

The walls 50, 52, 54, 56, 58 are formed with inner panels and outer panels which are spaced apart from each other. Insulation, for example, insulation sold under the trademark, INSULITE®, by E.H. O'Neill Company, Inc., is provided between the inner and outer panels of the walls 50, 52, 54, 56, 58, in order to meet the heat conduction requirements of UL Class 350 rating.

Partition wall 60 extends from the inner panel of rear wall 58 to the front edges of left and right walls 54, 56 and from the inner panel of left wall 54 to the inner panel of right wall 58. Partition wall 60 includes an upper panel and a lower panel. Insulation, for example, insulation sold under the trademark INSULITE®, is provided between the upper and lower panels of the partition wall 60. A recess 62 is provided in the upper panel of the partition wall 60, proximate the open end of the upper shelf 24, for receiving the latch 39 from the locking mechanism 38 on the door 30.

A seal point 70 is provided on the front edges of the walls 50, 54, 56, 60, which edges form the open front side of the shelf cavity 34. A seal 72 on the rear portion of the main body 34 of door 30 engages the seal point 70 when the door 30 is closed to cover the open front end of the shelf 24. A seal point 74 is provided by the walls 52, 54, 56, 60 forming the open front end of the cavity 64 for the drawer 26. The drawer 26 has a seal 76 which engages the seal point 74 when the drawer 26 is retracted into cabinet 20. Seal points 70, 74 and seals 72, 76 are preferably tongue-and-groove designs, although other designs meeting the requirements for the UL Class 350 rating are acceptable.

The compartment 28 of the preferred embodiment is generally rectangularly-shaped and includes a generally horizontal top wall 80, a generally vertical left wall 82, a generally vertical right wall 84, a generally vertical rear wall 86, and a front lip 88 which depends from the top wall 80 at the front end thereof. The top wall 50 of the frame 22 forms the bottom wall of the compartment 28. A compartment cavity 90 is defined by top wall 80, left wall 82, right wall 84, rear wall 86, top wall 38, and front lip 88. Thus, the compartment cavity 90 is preferably completely closed on five sides and has an open front. The open front is defined by an aperture 40 between the bottom end of the front lip 88 and the upper surface of the top wall 50 of the frame. Please note that, instead of having a front lip 88 defining aperture 40, compartment 28 could have a completely open front, with aperture 40 defined by top wall 80, left wall 82, right wall 84, rear wall 86, and top wall 50.

The width of the aperture 40 is slightly greater than the width of the door 30, which will retract through the aperture 40 and into the compartment 28. Drawer head slide 102*a* in right wall 84 and drawer head slide 102*b* in left wall 82 extend from the open front of compartment 28, rearwardly toward rear wall 86.

The compartment 28 is formed from metal, preferably steel. The compartment 28 sits on the top wall 50 and is secured to the frame 22 by welds, screws, nuts and bolts, interference fit, pins, or other suitable means of attachment.

A retracting mechanism 32 is shown in FIGS. 2, 3A-C, 4A-C, and 5A-B. Retracting mechanism 32 preferably has two sets of hinge assemblies. In the illustrated embodiment, all "a" components are one side of the fireproof filing cabinet 20 and all "b" components are on the other side, connected to the "a" components by the door extender 66. Accordingly, for each "a" component there is a corresponding and mirror-image "b" component. In the illustrated embodiment, "a" components are on the right side of the fireproof filing cabinet 20 and "b" components are on the left side of the fireproof filing cabinet 20. FIG. 2, which is a cross-section through line 2-2 of FIG. 1B, shows the left-side, "b" components. FIGS. 3A-C and 4A-C show the right-side, "a" components. Please note that a cabinet 20 of the present invention could have a single hinge assembly or could have three or more hinge assemblies.

The retracting mechanism 32 is attached to the door 30 and is used to retract the door 30 through the aperture 40 and into the cavity 64 in the compartment 28. The retracting mechanism 32 includes left and right first hinge members 104*a* and 104*b*, left and right second hinge members 106*a* and 106*b*, two hinge pins 108*a* and 108*b*, left and right levers 110*a* and 110*b*, left and right springs 112*a* and 112*b*, and left and right linkage pins 114*a* and 114*b*.

Figure 3C:
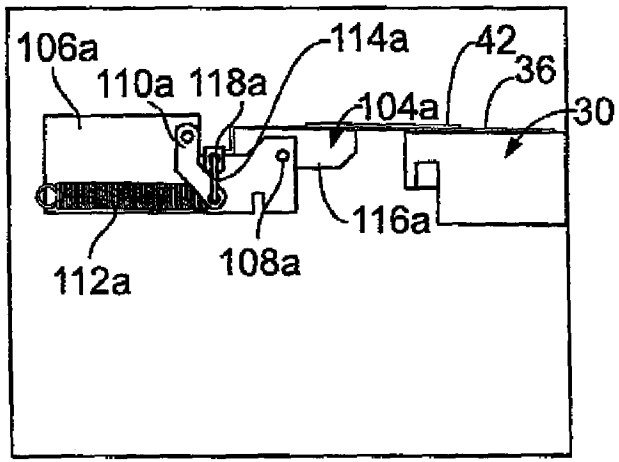
FIGS. 3A, 3B, and 3C are side cutaway views of a retracting mechanism used in the cabinet, showing the door in the closed position (FIG. 3A), partially open position (FIG. 3B), and open position (FIG. 3C)
Figure 3B:
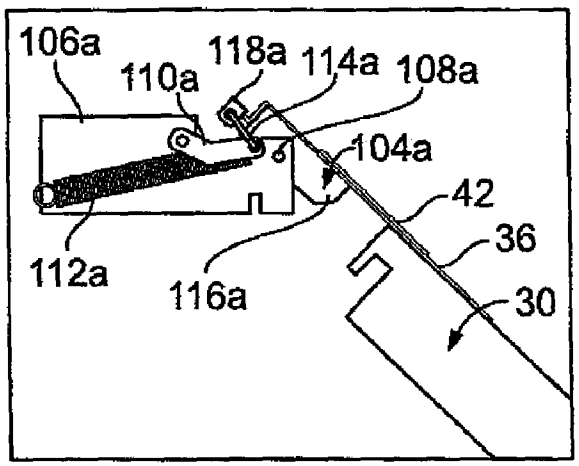
Figure 3A:
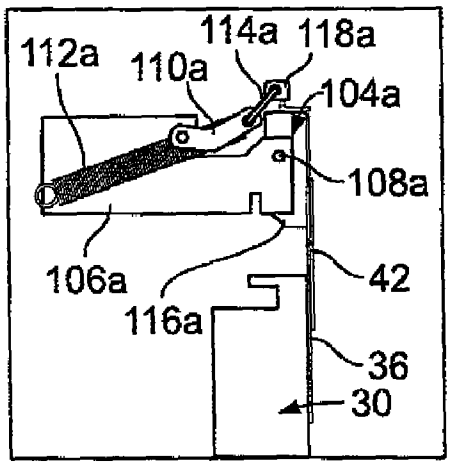
Figure 4C:
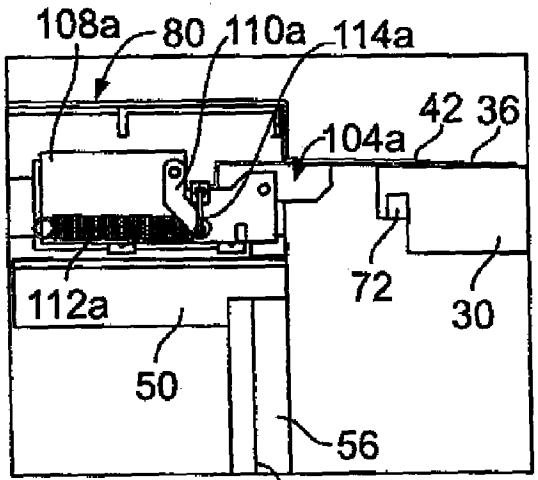
FIGS. 4A, 4B, and 4C are side cutaway views of the retracting mechanism, showing the door in the closed position (FIG. 4A), partially open position (FIG. 4B), and open position (FIG. 4C)
Figure 4B:
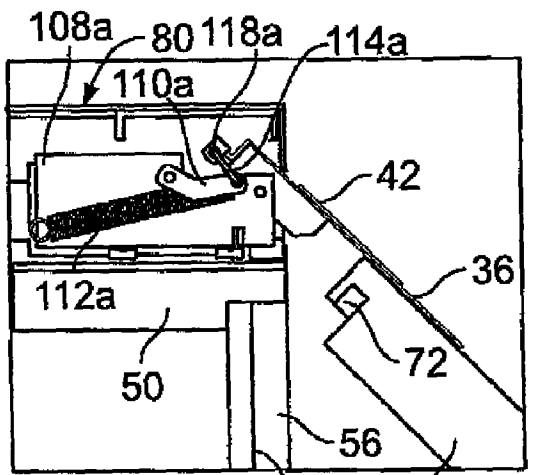
Figure 4A:
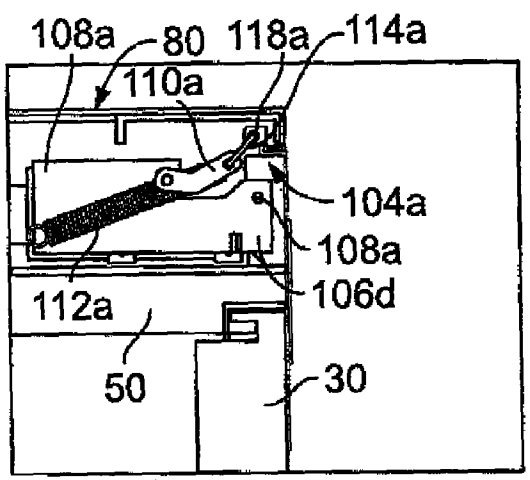
Figure 5A:
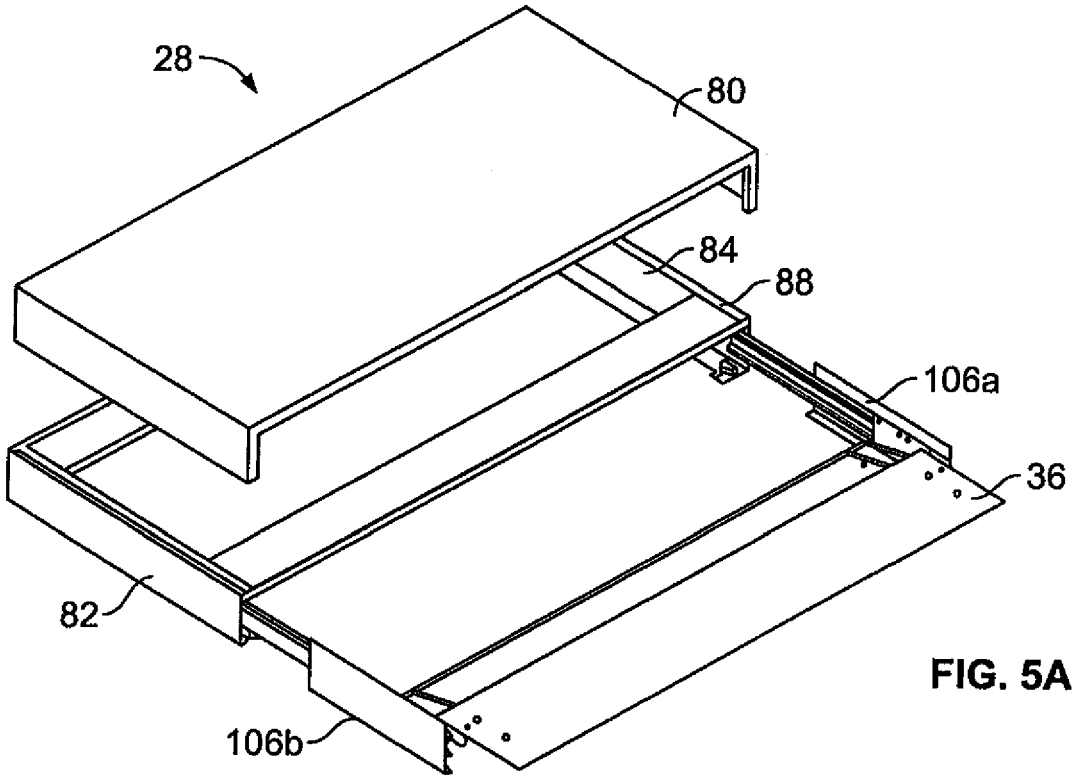
FIGS. 5A and 5B are exploded views of a compartment.
Figure 5B:
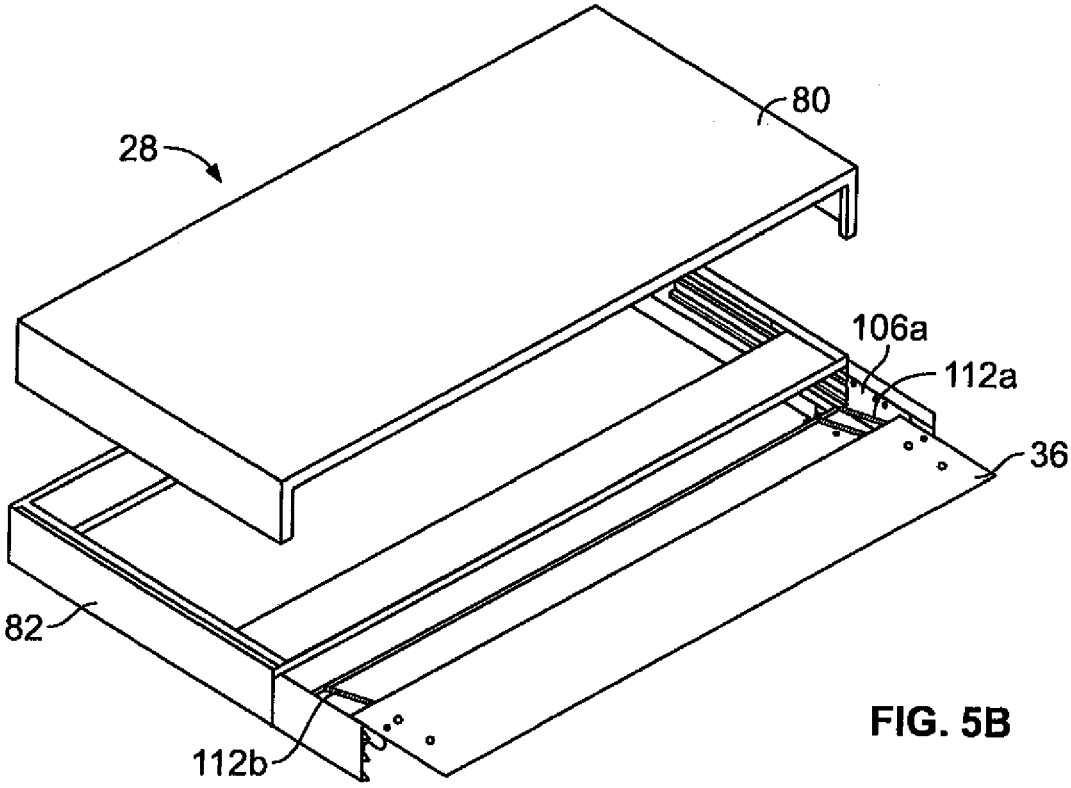

The right first hinge member 104*a* includes a generally rectangular plate 116*a* that is fixedly attached to the door extender 36 and pin receiving member 118*a* fixedly attached to an upper end of the plate 116*a*. The pin receiving member 118*a* extends upwardly from the plate 116*a*. A long edge of the plate 116*a* abuts against the upper end of the door extender 36 along its inner surface. The right first hinge member 104*a* is rotatably connected to the right second hinge member 106*a* through the hinge pin 108*a*. The hinge pin 108*a* is at approximately the midpoint of the plate 116*a*. The right second hinge member 106*a* is an elongated plate having first and second ends. The hinge pin 108*a* extends through the second end of the right second hinge member 106*a*, at an upper end thereof. The right second hinge member 106*a* slides in the right drawer head slide 102*a*. The left first hinge member 104*b* includes a generally rectangular plate 116*b* that is fixedly attached to the door extender 36 and pin receiving member 118*b* fixedly attached to an upper end of the plate 116*b*. The pin receiving member 118*b* extends upwardly from the plate 116*b*. A long edge of the plate 116*b* abuts against the upper end of the door extender 36 along its inner surface. The right first hinge member 104*b* is rotatably connected to the right second hinge member 106*b* through the hinge pin 108*b*. The hinge pin 108*b* is at approximately the midpoint of the plate 116*b*. The left second hinge member 106*b* is an elongated plate having first and second ends. The hinge pin 108*b* extends through the second end of the left second hinge member 106*b*, at an upper end thereof. The right second hinge member 106*b* slides in the right drawer head slide 102*b*. Accordingly, the door 30 rotates in an angle about the hinge pins 108*a*, 108*b*, from a closed position in which the open front end of the shelf 24 is covered and a seal is formed between seal point 70 and seal 72, as shown in FIGS. 3A and 4A, to an open position in which the door 30 is parallel to the top wall 50, as shown in FIGS. 3C and 4C. Pushing on door 30 in the open position then causes the second hinge members 106*a*, 106*b* to slide rearward in the drawer head slides 102*a*, 102*b*, respectively, so that the retracting mechanism 32 moves to the rear of the compartment 28, bringing the door 30 through the aperture 40 to a retracted position inside the compartment cavity 90 for out-of-the way storage.

Because the door 30, being fireproof, is fairly heavy, a lift assist mechanism is preferably supplied. Conventionally, a spring would extend from a first hinge member to a second hinge member. In the preferred embodiment of the present invention, however, each spring 112*a*, 112*b* is attached to a lever 110*a*, 110*b* that is attached to both hinge members 104*a*, 1048*b*; 106*a*, 106*b*, so the lifting force supplied by the springs 112*a*, 112*b* increases as the door 30 is opened.

As shown in FIGS. 2 through 4, the levers 110*a*, 110*b* are elongated plates that have first and second portions which are angled relative to each other. A first end of the left lever 110*a* is rotatably attached to the left second hinge member 106*a* at approximately the midpoint thereof.

A second end of the left lever 110*a* is attached to a second end of the left spring 112*a*. A left linkage pin 114*a* connects the second end of the left spring 112*a* and the second end of the left lever 110*a* to the left pin receiving member 118*a*. The first end of the left spring 112*a* is fixedly attached to the first end of the left second hinge member 106*a* at a lower end thereof. In an identical manner, a first end of the right lever 110*b* is rotatably attached to the right second hinge member 106*b* at approximately the midpoint thereof. A second end of the right lever 110*b* is attached to a second end of the right spring 112*b*. A right linkage pin 114*b* connects the second end of the right spring 112*b* and the second end of the right lever 110*b* to the right pin receiving member 118*b*. The first end of the right spring 112*b* is fixedly attached to the first end of the right second hinge member 106*b* at a lower end thereof.

Accordingly, when the door 30 is in its closed position, as shown in FIGS. 3A and 4A, the springs 112*a*, 112*b* are extended. As the door 30 begins to rotate upwards, as shown in FIGS. 3B and 4B, the springs 112*a* and 112*b* begin to compress. As the door 30 rotates ninety degrees to a position parallel to the top wall 50, as shown in FIGS. 3C and 4C, the springs 112*a*, 112*b* are fully compressed. Accordingly, the springs 112*a*, 112*b* produce their greatest force when the door 30 is in its closed position. This force gradually decreases as the door 30 is lifted, until no force is applied by the springs 112*a*, 112*b* when the door 30 has rotated ninety degrees to the position shown in FIGS. 3C and 4C. Accordingly, raising and lowering the door 30 is practically no assist from approximately forty-five degrees (FIGS. 3A and 4A) on up (FIGS. 3C and 4C).

In this open position, the door 30 can be pushed through the aperture 40, as the second hinge members 106*a*, 106*b* slide along the drawer head slides 102*a*, 102*b*, until the door 30 has completely retracted within the compartment 28. To close the shelf 24, the user pulls the door 30 out of compartment cavity 90, through aperture 40, from the retracted position to the open position, and presses downward. Little or no force will be required to move the door 30 halfway down (FIGS. 3B and 4B), and, because of the weight of the door 30, only gentle pressure will be required to move the door 30 into its closed position (FIGS. 3A and 4A).

The compartment 28 and the retracting mechanism 32 can be retrofitted to existing filing cabinets. Please note also that, while the compartment 28 is illustrated as being on top of the shelf 24, the compartment 28 could be mounted below the shelf 24 or on either side of the shelf 24 without departing from the principles of the present invention.

In another embodiment, side walls 54, 56 are slide rollers mounted on frame 22, instead of sheet steel having drawer head slides 102*a*, 102*b*. In this embodiment, door 30 retracts into a position above top wall 50, but not inside a defined space such as compartment cavity 90.

While preferred embodiments of the present invention are shown and described, it is envisioned that those skilled in the art may devise various modifications of the present invention without departing from the spirit and scope of the appended claims.

The invention claimed is:

1. A fireproof filing cabinet comprising:

a frame comprising a plurality of side walls defining a frame cavity, said frame cavity having a rear wall closing a rear side and being open on a front side to define an open front side, said side walls having front edges surrounding said open front side;

a compartment mounted to said frame, said compartment including a plurality of walls defining a compartment cavity therein and an open front side;

a door having a front portion and a rear portion and formed to cover said open front side of said frame cavity;

a retracting mechanism comprising a first hinge member mounted on said door;

a second hinge member rotatably attached to said first hinge member and slidably mounted within said compartment cavity;

a lever having a first end and a second end, said first end of said lever rotatably attached to said second hinge member;

a linkage pin having first and second ends, said second end of said lever rotatably attached to said first end of said linkage pin, said second end of said linkage in pivotally attached to said first hinge member;

a spring having first and second ends, said first end of said spring attached to said second hinge member and said second end of said spring rotatably attached to said second end of said lever; and said door being rotatable about said retracting mechanism from a closed position proximate said front edges of said side walls wherein said rear portion of said door engages said front edges of said side walls to form a seal, to an open position remote from said front edges of said side walls, and said door being slidable from an open position, through said open front side of said compartment to a retracted position within said compartment cavity.

2. The fireproof filing cabinet of claim 1, wherein said retracting mechanism is mounted on a side wall of said compartment and a second, like-formed, retracting mechanism is mounted on an opposite side wall of said compartment.

3. The fireproof filing cabinet of claim 2, wherein said compartment is mounted on top of said frame.

4. The fireproof filing cabinet of claim 1, wherein said compartment is mounted on top of said frame.

5. The fireproof filing cabinet of claim 1, wherein said door includes a main body which covers said front end of said frame cavity and a door extender extending from said main body, said first hinge member being mounted on said door extender, said door extender spacing said main body from said retracting mechanism.

6. The fireproof filing cabinet of claim 1, further comprising a sliding shelf mounted in said frame cavity.

7. The fireproof filing cabinet of claim 1, wherein said frame further comprises a plurality of walls forming a drawer cavity having a drawer slidably mounted therein.

8. The fireproof filing cabinet of claim 1, wherein said door engages said front edges to form a tongue-and-groove seal.

* * * * *